United States Patent [19]

Bitko et al.

[11] 3,976,960

[45] Aug. 24, 1976

[54] MERCURY SWITCH

[75] Inventors: Sheldon S. Bitko, East Brunswick, N.J.; Charles Davidoff, Manhasset, N.Y.

[73] Assignee: Fifth Dimension Inc., Princeton, N.J.

[22] Filed: Jan. 7, 1974

[21] Appl. No.: 431,424

[52] U.S. Cl. ..... 335/58

[51] Int. Cl.[2] ..... H01H 1/08

[58] Field of Search ..... 335/58, 56; 204/43 P, 204/49; 117/130 E

[56] References Cited

UNITED STATES PATENTS

| | | | |
|---|---|---|---|
| 3,264,199 | 8/1966 | Fassell, Jr. et al. | 204/43 P |
| 3,697,906 | 10/1972 | Bitko | 335/58 |
| 3,717,482 | 2/1973 | Gulla et al. | 117/130 E |

*Primary Examiner*—Harold Broome

*Attorney, Agent, or Firm*—Burns, Doane, Swecker & Mathis

[57] ABSTRACT

An attitude insensitive mercury relay including a hermetically sealed non-magnetic enclosure composed of a header and header cap welded together in a high pressure hydrogen atmosphere, including one or more stationary contacts extending insulatedly into the enclosure and a magnetic diaphragm as armature, in the form of a single planar tight spiral having physically separated turns. In one form of a the device, the interior of the enclosure and the diaphragm may be mercury wettable, excluding only an insulating feed-through button as provided for a stationary contact, and also excluding a portion of the face of the contact, which is intended to sustain impact by the armature, the mercury wettable portion of that face being indented with respect to the impact area, and the quantity of mercury in the enclosure being sufficient, but only sufficient, to sustain a thin layer of mercury on the mercury wettable surfaces. In other forms the enclosure may be non-metallic, e.g., ceramic, provided with mercury wettable screen surfaces or fabricated of non-mercury wettable material, e.g., magnetic material. Mercury wettability is achieved by plating with electroless nickel, which is more strongly wettable than ordinary nickel or even platinum, but which also has the advantage of forming superior welds, or by plating electrolytically with nickel containing phosphorous or analogous material which renders the nickel mercury wettable in even the presence of oxygen.

8 Claims, 8 Drawing Figures

MERCURY SWITCH

This application is related in subject matter to Ser. No. 252,810, filed May 12, 1972, for Mercury Switch inventor Sheldon S. Bitko, and assigned to the assignee of the present application.

BACKGROUND OF THE INVENTION

In parent applications Ser. Nos. 066,534 and 071,294 the quantity of mercury employed, while insufficient to form a pool regardless of the attitude of the relay, may be in excess of that found most desirable in order to assure that the contacts will never be dry. In the present application, devices are employed for minimizing the possibility of dry contacts forming, due to maldistribution of mercury when smaller amounts are employed. These devices include placing the armature so close to the enclosure walls that the walls are touched by the armature at each operation, thereby assisting mercury redistribution. This is particularly valuable if a non-mercury wettable enclosure is employed. Further, the armature may be secured to the enclosure at two diametrically opposed points only, or preferably, left floating in mercury, permitting it to translate nearly planarly, and thereby squeezing mercury fillets which always exist during operation. A helical capillary groove, to act as a wick for mercury, may be formed in the armature, and/or in the casing, to assist in distributing mercury. Alternatively, mercury wettable surfaces may be roughened, for the same purpose. In addition, the armature is elongated, and mercury possesses high electrical resistivity. To reduce internal resistance of the relay, the armature may be laminated to include material of lower resistivity than is possessed by mercury.

The initial impetus toward the relay of the present invention and many of its underlying concepts was provided in Donath, U.S. Pat. No. 3,144,533. That patent provides the concept of utilizing a thin layer of mercury in a mercury switch, which covers mercury wettable surfaces in the enclosure for the switch, but is inadequate to form a free flowing pool of mercury regardless of the attitude of the switch. That patent discloses three distinct species of its basic concept, two of which employ a slug, freely riding on a layer of mercury because it is unwettable by the mercury, and the other being a reed switch. It has been believed crucial to the Donath device to utilize a very small physical structure and large wettable areas relative to the size of the device, in order to solve a crucial problem, i.e., the maintenance of a liquid layer over long periods of time as the relay operates. Liquid on the switch contacts is continuously being lost by impact and for other reasons, and must be able to replenish itself automatically as a layer, if the switch is to remain operative and this must occur regardless of the attitude of the switch.

The present invention employs a metallic envelope, a stationary contact or contacts, anchored via a non-wettable insulator or insulators extending through a wall or walls of the envelope, and an armature in the form of a single spiral, such as is used as a mainspring in a watch. The turns of the spiral have spacings adapted to hold mercury, and the entire spiral is mercury wettable, and all the turns of the spiral interact with each other and with the mercury, and the surface may be grooved or roughened to facilitate flow of mercury. Both header and cap may be non-magnetic, or the header can be magnetic and the cap non-magnetic, or vice versa, or both header and cap can be magnetic if non-magnetic windows are provided in the magnetic element, e.g., at the insulators, to permit entrance of magnetic flux. It follows that the spiral provides a very considerable high surface tension reservoir of mercury as a continuous thin layer on its surface, and the layer tends to reintegrate itself when broken by operation of the relay. The spring can be small or large, and there is no longer a requirement that the switch be small, as in the Donath device. It can be made to handle 50.A of current if desired. The interior walls of the enclosure, which is in the form of a header and cap welded together, may be mercury wettable or not, except that the insulators which enable stationary contacts to feed through must be non-wettable. The spiral is physically secured at its perimeter to the envelope, either by welding or clamping or it may float in a circumferential securing slot, and the envelope can then constitute a switch output electrode, the spiral operating as a damped reed. Damping factors can be inserted for avoiding reed self-vibration. The very long reed spring can be made extremely flexible, so that in operation parts of it can impact against the envelope. This impact against the envelope has no effect on switching but does aid in redistributing mercury and is particularly valuable if the enclosure is non-wettable. In the present device the spring constitutes a major reservoir of mercury, and the structure lends itself to fabrication in relatively large diameter, thin envelopes, which are inexpensive to make because they can be welded in a gaseous atmosphere under pressure, and thus readily filled with gas, as hydrogen, at high pressure, say 200 – 250 pounds/-square inch.

Diaphragm type switches which do not employ mercury are commercially available. These employ diaphragms which have circular slots or plural spiral slots. There are, however, no spiral slotted discs, having many turns, say three, presently employed in relays, so that the latter represent highly elongated, but compact reeds. The spring device or elongated reed of this invention can be advantageously utilized in a relay which duplicates the present relay except in that mercury is omitted, because the spring is remarkably flexible, and therefore responds remarkably rapidly, yet without oscillation, or with highly damped vibration, to small magnetic forces. Damping can be controlled in terms of spring design, mercury layer distribution, and the effect of the gas under pressure, or any of these.

The present invention, as applied in a mercury switch, requires that there be a layer of mercury on mercury wettable surfaces. The term "layer" may be distinguished from film and from pool.

A mercury film is one in which the position and shape of the liquid mercury do not change with respect to the solid. Films between relatively movable metal surfaces must be avoided since sticking results. A mercury layer is one in which the shape of the mercury changes but the mercury remains on average in contact with the solid, despite changes of attitude of the surface, or subjection thereof to shock or vibration. A mercury pool is one in which both the shape and location of the mercury change on a statistical and transient basis, the pool, at least as a whole, not being relatively permanently attached to a wettable surface.

When a mercury relay operates, mercury flies in all directions for each impact between the contacts. In addition, mercury is displaced due to forces, i.e., those of gravity, vibration and shock, temperature gradients and forces of surface tension. It is essential that a mechanism be present in a mercury relay for relocating mercury which has been displaced, to locations such that contacts will not be short circuited, or become dry, and in the present system this must occur regardless of switch attitude.

It can be shown by mathematical analysis that the available surface tension force to restrain a given volume of mercury on a mercury wetted surface is proportional to the length of the edge of the surface. It follows that breaking up a surface into small discrete areas increases the net surface tension forces over the total area, because it increases net length of edge; but perhaps more important, this facilitates flow of mercury so that it may very rapidly redistribute itself as a continuous layer when operation of the contacts ruptures the layer. A spiral spring has total edge length proportional to its length, but the effective edge length can be extended by slotting the turns and the cap and header inner surfaces can be improved in respect to surface tension if lined with spiral elements, either grooves or protuberances, or with fine mesh screening, or by merely roughening the surface which also assists in redistribution.

The advantages which the present system present over the structure of Donath is that a free slug is avoided, movement of the latter requiring considerable energy expenditure, and the only frictional forces which need be avoided are those internally of the spring and those due to viscosity of mercury and gas, leading to high sensitivity. Second, the enclosure of the present invention can be resistance welded closed, and this can be done in a 200 - 250 psi Hydrogen atmosphere, at low cost. The Donath device as presently designed cannot be welded closed, and hence cannot practically enclose high pressure gas. Third, the present device can be made large, and therefore capable of carrying high current, which is not true of the Donath unit. The Donath unit is a high precision unit, in terms of fabrication techniques, and therefore tends to be expensive. The present unit is extremely inexpensive because it lends itself to mass production by welding of the header to the cap in one operation.

It is found that the switch of the invention can have high resistance when conductive, because mercury has high resistivity and the reed involved is about 1½ inches long. The mercury path along the reed, according to the present invention, is shunted by the reed itself, which is laminated to include a layer or layers of higher conductivity material than the conductivity of mercury.

Problems exist in respect to sticking of the armature to the stationary contact. This is avoided according to the teaching of the Bitko applications for United States patent, supra. The device of the present application also meets the problem of securing the armature within its enclosure, by permitting it to float on layers of mercury, which reduces welding problems. The present application also concerns itself with aiding redistribution of mercury by utilizing one or more of the following features: (1) adding a spiral capillary slot to the turns of the spiral; (2) adding spiral capillary slots to the inner surfaces of the enclosure; (3) adding projections to the inner surface of the enclosure against which the armature may impinge; (4) spacing the armature from the cap and/or header so closely that in the operated condition mercury continuously contacts the cap and/or header; (5) roughening mercury wettable surfaces, e.g., the armature.

In the prior art surfaces were rendered mercury wettable by coating those surfaces with platinum. Platinum is an expensive metal, and substitution is therefore desirable. Nickel is known to be mercury wettable, but it readily oxidizes, and when oxidized is no longer wettable. This renders nickel plating, to achieve wettable surfaces, undesirable. It has been found that if nickel is combined with phosphorous it provides a hard stable surface which is more wettable than platinum, but which is also very hard and smooth. The addition of phosphorous, perhaps of the order of 5–10%, to nickel, changes the surface properties of the nickel so that even in the presence of oxygen the nickel remains highly mercury wettable. The nickel-phosphorous combination may be achieved either by electroless plating, which in the usual commercial process results in the incorporation of phosphorous into the nickel, or by electrolytic plating, in which case suitable phosphorous compounds must be incorporated in the usual nickel chloride plating bath.

SUMMARY

An improved reed relay employing a hermetically sealed enclosure consisting of a header and a cap welded together and containing a spiral spring as an armature. The latter is laminated to include high conductivity metal, is provided with a helical capillary groove or surface roughening to provide a wick for mercury, is free to float in the mercury, i.e., is not welded to the enclosure, is operative in an atmosphere of hydrogen at about 200 – 250 psi, and contains only enough mercury to form thin layers on the mercury wettable inner surfaces of the enclosure and the armature, or the armature alone if the enclosure is fabricated of mercury unwettable material. The armature is so close to the walls of the enclosure, about 10. mils, that contact between armature and walls is inevitable for each actuation of the armature, which so assists redistribution of mercury that the quantity of mercury in the switch can safely be reduced from that which might otherwise be needed. Utilization of a minimum quantity of mercury tends to reduce the possibility that a pool of mercury will form and either short circuit contacts, or steal mercury from the contacts sufficiently to produce dry contacts. An improved stationary contact is also employed, which is nonsticking by virtue of its construction, a feature not novel in this application. The wettable surfaces of the enclosure, apart from the contact or contacts, are coated either by electroless welding or electrolytic welding with an alloy of nickel and phosphorous, as are all the surfaces to be welded.

THE DRAWINGS

DETAILED DESCRIPTION

Figure 1:
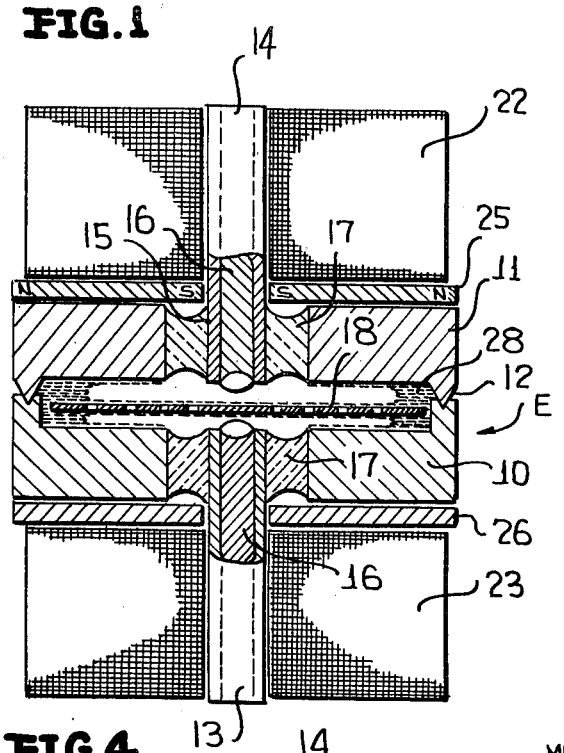
FIG. 1 is a view in section of a mercury relay according to the invention, employing a floating armature.

Referring now to the drawings, 10 is a header cap which may be fabricated of metal, and which may be internally mercury wettable. The metal may be non-magnetic, preferably, but magnetic material, particularly carbon steel, has advantages in respect to making glass to metal seals. The latter need not be mercury wettable. Welded to the cap 10 is a header 11, which may be of the same material as cap 10, if desired, as a matter of choice. The header 11 is welded to the cap by a circumferential resistance weld 12. Through the headers, axially thereof, extend stationary contacts 13, 14, in the form of cupro-nickel cored rods. The outer layer of core is a non-mercury-wettable covering 15, which extends inwardly of the header and cap farther than does the core 16. The pins 13, 14 are magnetic and are insulated from headers and cap 10, 11, by glass seals 17, which are nonwettable by mercury.

A spiral armature 18 is located interiorly of the enclosure E, formed by cap 10 and header 11. The armature center 19, when energized by current in coil 22, or 23, moves toward a pin. Permanent magnets 25, 26 are latching devices which render the relays bi-stable, it this is desired, in that after the armature has deflected to one side or the other, the magnetic circuit length of the side of the relay which includes the closed contacts is minimum and the armature therefore holds stably. In addition, surface tension forces tend to maintain closed contacts in closed condition.

The armature 18 is a multi-turn spiral which acts as a long reed having its movable contact terminus 19 at the center of the spiral. The length of the spiral may be about 2 inches, while its diameter may be about ⅝ inch. Optimally, about 3 - 5 turns may be used, but fewer or more are useful, and a turn spacing of about 0.0075 inch is used.

The spiral armature 18 is highly flexible, like a main spring of a watch, and is mercury wettable. The inner surfaces of the enclosure E and all surfaces of the armature 18 are covered by a thin layer of mercury, in one embodiment of the invention, there being only enough mercury to form the layer and insufficient to form a pool of mercury. This assures that the relay is position insensitive, since mercury layers adhere to mercury wettable surfaces with large surface tension forces.

Figure 4:
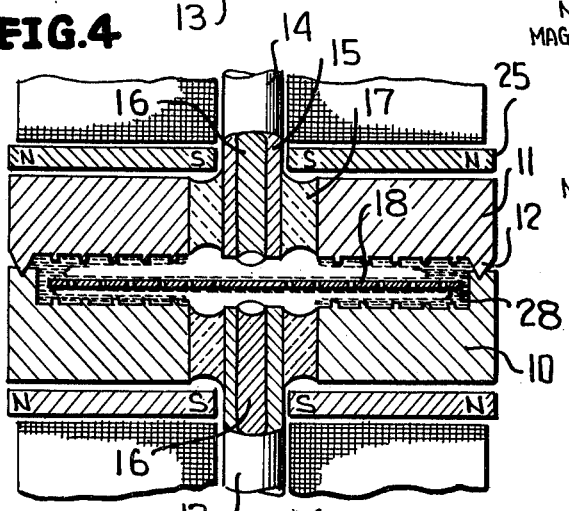
FIG. 4 is a view in section of a variant of the relay of FIG. 1, employing enclosure walls having protuberances.
Figure 5:
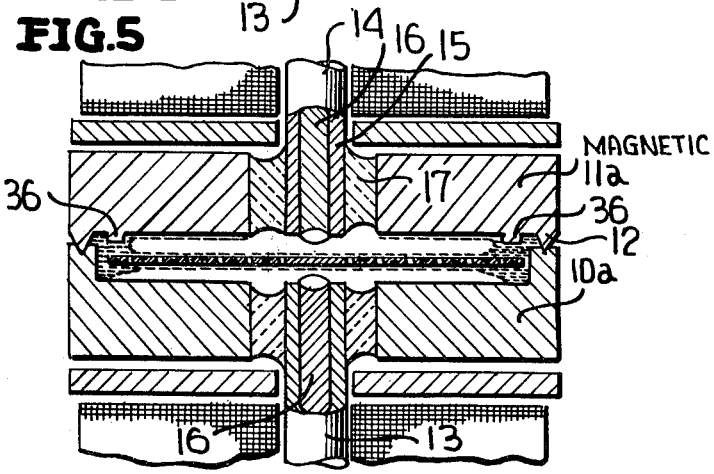
FIG. 5 is a view in section of a variant of the relay of FIG. 1, employing enclosure walls having grooves.

The relay as described, to this point, in the detailed description, is essentially the relay of FIG. 5 of Ser. No. 66,534, supra. The novel features of the present relay are described hereinafter. In Ser. No. 66,534, the armature is welded to the cap or header, or is clamped between these, at its outer edge. In the present system, the armature floats in mercury, specifically within fillets, as 28, which form at the edges of the enclosure H in FIGS. 1 and 4, or by adhesion to an annulus 36 in FIG. 5. Thereby, welding problems are eliminated, but also the armature acquires an additional possibility of movement, i.e., as a piston, as well as a resilient reed. This enables firmer contact to be achieved between the armature 18, and the stationary contacts 14. Further, the armature, over areas far from its center, can contact or closely approach and touch the inner walls of enclosure E (recalling the presence of an intervening mercury layer), thereby assisting in redistribution of mercury as between walls and the armature as the armature opens and closes.

The only surfaces within the enclosure E which must not be mercury wettable in one embodiment of the invention are (1) the surfaces of insulators 17, and the outer surfaces 15 and rims of pins 14. The cores 16 of the pins 14 are mercury wettable and their ends are set back slightly so that the core ends are never directly contacted by the armature. The core does carry a layer of mercury and hence does make electrical contact with the armature, but not mechanical contact.

Figure 2:
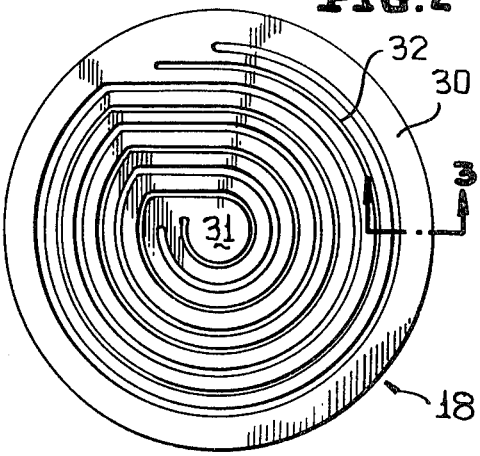
FIG. 2 is a view in plan of an armature utilized in the relay of FIG. 1, and having a capillary groove.
Figure 3:
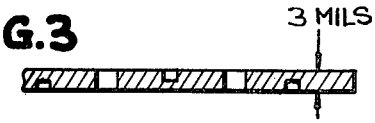
FIG. 3 is a view in section taken on the line 3 — 3 of FIG. 2.
Figure 7:
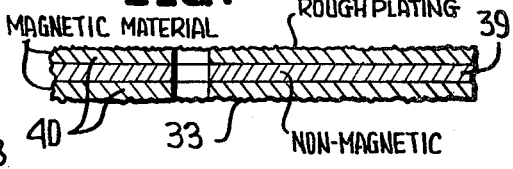
FIG. 7 is a partial view in section of a laminated armature in a second form.
Figure 8:
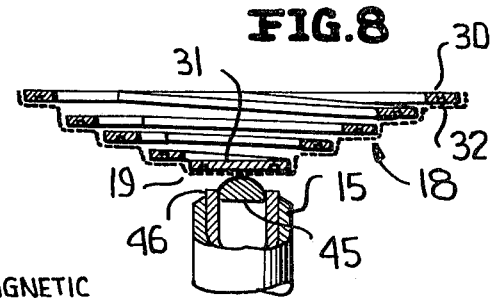
FIG. 8 is a view in section of an actuated armature and stationary contact, enlarged.

In FIG. 2 is illustrated in plan, the armature of the invention, consisting of turns 30, helically proceeding inwardly to a center 31. The armature may be about 3 mils thick. A capillary groove 32 extends along the turns of the armature in one embodiment of the invention to effect increased surface tension and because mercury flows more easily along a channel. However, the capillary grooves can be replaced or added to by an alternative expedient. The surfaces of the armature may be plated with mercury wettable material, e.g., nickel on copper, or copper on nickel, but the plating may be made rough, as in FIG. 7, at 33, which also increases surface tension and facilitates flow of mercury. Likewise, the inner surfaces of the header and cap may be provided with capillary grooves, or protuberances, or be roughened to effect increased surface tension and facilitate flow since in effect roughening the surface provides multiple channels, where as in FIGS. 1 and 4, the enclosure is non-magnetic and mercury wettable. If the enclosure is of magnetic material and non-wettable, as in FIG. 5, these expedients are not required for the enclosure, but an annulus 36 of nickel or other wettable material is welded to one of the header and cap or to both to provide good contact between the header and armature via the mercury. This annulus may be roughened or otherwise have its area increased.

Figure 6:
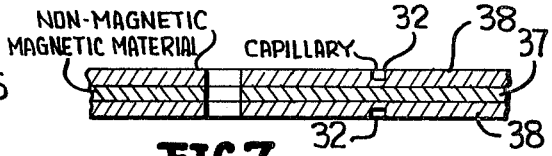
FIG. 6 is a partial view in section of a laminated armature in a first form.

The armature itself may be laminated. It must be magnetic, and its surface must be mercury wettable. It can have a magnetic core 37 and non-magnetic mercury wettable surfaces 38 plated or laminated thereon (FIG. 6) or it may be internally non-magnetic 39 and have magnetic layers 40 coated thereover, in turn thinly plated with a rough surface of wettable material, e.g., nickel, copper. In either event at least one of the layers of which the armature is fabricated must have far lower resistivity than does mercury, in order to shunt the path through mercury from the enclosure to the stationary contact 14. The stationary contact must have a recessed mercury wettable area 45, and a projecting area 46, surrounding area 45, which accepts physical impacts from the armature. This avoids sticking and has been dealt with fully in co-pending Bitko applications on this subject. The outer layers of the armature can be electrochemically deposited, and the capillaries and slots can be electrochemically or chemically etched.

In accordance with one feature of the present improvement, the internal surfaces of cap 10 and header 11 are plated with a nickel-phosphorous alloy, and the plating extends to the welded areas at the rims of cap 10 and header 11, and to the spiral armature 18. The plating may be electroless or electrolytic.

Electroless nickel plating is based on the catalytic effect which certain active metals have on the reducing action of sodium hypophosphite for nickel ions. In this process, which is conventional, the metal deposited is a catalyst for its own reduction, and the coating formed is not pure nickel, but contains phosphorous (4–12%), which forms a highly mercury wettable homogeneous surface having no porosity.

As a further benefit it is found, when a nickel-phosphorous joint is resistance welded, that due to the presence of phosphorous in the nickel, a very superior weld is achieved, largely because the alloy of nickel and phosphorous has a relatively low welding temperature, and possibly in part because the welded surface is flatter and more uniform than is the case for machined metal on which the plated surface is formed. It is an unexpected result that nickel-phosphorous forms a weld superior to nickel alone, in the nature of a brazed joint.

In prior art internal areas of the enclosure E, except those pertaining to the contact 14, 15, 16 and the insulator 17, were coated with platinum by electrolytic deposition. Platinum has been found satisfactory because it does not oxidize, and has the requisite wettability to achieve the mercury layers required in the present switch or relay. It has been found that nickel cannot be substituted for platinum because it tends to oxidize, and when oxidized becomes unwettable by mercury, and in the presence of $H_2O$ also dewets. However, alloys of nickel and phosphorous containing at least several percent of phosphorous do not dewet in these circumstances and are more mercury wettable than unoxidized nickel. The coating of nickel and phosphorous can be formed either electrolytically or electrolessly, by conventional methods.

The nickel-phosphorous coating may have thicknesses as small as 0.0001 0.0002 inch, but can go to 0.001 inch.

What we claim is:

1. A hermetically sealed switch, comprising a concave dish of resistance weldable metal, a magnetic flexible reed armature located in said dish and electrically connected to said dish, a stationary contact, an insulator extending insulatedly through said dish from exteriorly to interiorly of said dish, said stationary contact extending through said insulator, a closure cap of resistance weldable metal peripherally welded about the periphery of said dish to form with said concave dish a hermetically sealed enclosure, the welded surfaces of said cap and header being coated with electroless nickel.

2. A switch, consisting of a concave dish of resistance weldable metal, a magnetic armature located in said dish and electrically connected to said dish, a stationary contact, an insulator extending insulatedly through said dish from exteriorly to interiorly of said dish, said stationary contact extending through said insulator, a closure of resistance weldable metal peripherally welded about the periphery of said dish to form a hermetically sealed enclosure, wherein said armature is a spiral spring having substantially the outer diameter of the interior of said enclosure and secured peripherally to said enclosure, the welded surfaces of said dish and closure being coated with an alloy of nickel and a member of the phosphorous family.

3. A switch, consisting of a concave dish of resistance weldable metal internally coated with electroless nickel, a magnetic armature coated with electroless nickel located in said dish and electrically connected to said dish, a stationary contact, an insulator extending insulatedly through said dish from exteriorly to interiorly of said dish, said stationary contact extending through said insulator, a closure of resistance weldable metal coated with electroless nickel peripherally welded about the periphery of said dish to form a hermetically sealed enclosure, wherein said armature is a spiral spring having substantially the outer diameter of the interior of said enclosure and secured peripherally to said enclosure, wherein said armature is secured peripherally to said enclosure.

4. A switch comprising an enclosure consisting of a unitary concave dish of resistance metal coated with an alloy of nickel and phosphorous, a unitary closure plate of resistance weldable metal coated with electroless nickel, said unitary concave dish and said unitary closure plate being peripherally resistance welded to each other via a coating of said alloy to form and complete said enclosure, at least one electrode extending insulatedly through one of said concave dish and said closure plate, and an armature coated with said alloy nickel located interiorly of said enclosure in proximity to said at least one electrode, wherein said armature is laminar and includes at least one layer of magnetic material and at least one layer of non-magnetic material, said non-magnetic material having lower resistivity than mercury.

5. A switch comprising a sealed enclosure consisting of a unitary concave dish of resistance weldable metal, a unitary closure plate of resistance weldable metal, said unitary concave dish and said unitary closure plate being peripherally resistance welded to each other to form and complete said enclosure, at least one electrode extending insulatedly through one of said concave dish and said closure plate, and a flexible reed armature located interiorly of said enclosure in proximity to said at least one electrode, said reed armature and the welded surfaces of said dish and closure plate and the interior of said enclosure being coated with an alloy of nickel and phosphorous.

6. A switch comprising an enclosure consisting of a unitary concave dish of resistance metal coated with electroless nickel, a unitary closure plate of resistance weldable metal coated with electroless nickel, said unitary concave dish and said unitary closure plate being resistance welded to each other about a periphery coated with electroless nickel to form and complete said enclosure, at least one electrode extending insulatedly through one of said concave dish and said closure plate, and an armature located interiorly of said enclosure in proximity to said at least one electrode, wherein said armature is laminar and includes at least one layer of magnetic material and at least one layer of non-magnetic material, said non-magnetic material having lower resistivity than mercury, wherein said armature includes mercury wettable electroless nickel surfaces.

7. A switch comprising an enclosure consisting of a unitary concave dish of resistance metal, a unitary closure plate of resistance weldable metal, said unitary concave dish and said unitary closure plate being peripherally resistance welded to each other to form and complete said enclosure, at least one electrode extending insulatedly through one of said concave dish and said closure plate, and an armature located interiorly of said enclosure in proximity to said at least one electrode, wherein said armature is laminar and includes at least one layer of magnetic material and at least one layer of non-magnetic material, said non-magnetic material having lower resistivity than mercury, wherein said armature includes mercury wettable surfaces, wherein said armature is sufficiently close to an inner surface of said enclosure that in response to actuation of said armature contact is made by said armature with said inner surface of said enclosure that in response to actuation of said armature contact is made by said armature with said inner surface, thereby assisting mercury redistribution, and wherein the interior surfaces of said enclosure and said armature and the weld which completes said enclosure have coatings of nickel alloy including a member of the phosphorous family.

8. A switch comprising an enclosure consisting of a unitary concave dish of resistance metal, a unitary closure plate of resistance weldable metal, said unitary concave dish and said unitary closure plate being peripherally coated with electroless nickel and resistance welded to each other to form and complete said enclosure, at least one electrode extending insulatedly through one of said concave dish and said closure plate, and an armature located interiorly of said enclosure in proximity to said at least one electrode, wherein said armature is laminar and includes at least one layer of magnetic material and at least one layer of non-magnetic material, said non-magnetic material having lower resistivity than mercury, wherein said armature includes mercury wettable surfaces, wherein said armature is spiral and includes turn spacings which are mercury wettable.

* * * * *